US006382061B1

(12) United States Patent
Paczonay

(10) Patent No.: US 6,382,061 B1
(45) **Date of Patent: *May 7, 2002**

(54) METHOD FOR CUTTING A RESILIENT WORKPIECE

(76) Inventor: Joseph Paczonay, 42799 Deauville Park Ct., Fremont, CA (US) 94538

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/797,960

(22) Filed: Feb. 10, 1997

Related U.S. Application Data

(63) Continuation-in-part of application No. 08/678,585, filed on Jul. 11, 1996, now Pat. No. 5,791,510, and a continuation-in-part of application No. 08/615,611, filed on Mar. 13, 1996, now Pat. No. 5,601,207.

(51) Int. Cl.[7] ..... B26D 7/14

(52) U.S. Cl. ..... 83/21; 83/18; 83/175; 83/454; 83/465; 83/620; 83/697; 83/178

(58) Field of Search ..... 30/139, 361, 362; 83/17, 18, 20, 21, 30, 175, 176, 454, 456, 460, 465, 618, 670, 648, 682, 697, 679, 178, 181, 182

(56) References Cited

U.S. PATENT DOCUMENTS

| | | | | | |
|---|---|---|---|---|---|
| 274,447 | A | * | 3/1883 | Kennish | 251/143 |
| 1,617,013 | A | * | 2/1927 | Denmire | 83/176 |
| 2,219,604 | A | * | 10/1940 | Trotter | 222/207 |
| 2,371,734 | A | * | 3/1945 | Buttress | 83/51 |
| 2,503,353 | A | * | 4/1950 | Pugh | 83/175 X |
| 2,866,501 | A | * | 12/1958 | George | 83/175 X |
| 3,196,728 | A | * | 7/1965 | Snow | 83/618 |
| 3,532,016 | A | * | 10/1970 | Lane | 83/175 |
| 3,910,213 | A | * | 10/1975 | Hoenig et al. | 225/103 X |
| 4,488,466 | A | * | 12/1984 | Jones | 83/175 |
| 5,085,349 | A | * | 2/1992 | Fawcett | 222/175 |
| 5,403,293 | A | * | 4/1995 | Grabenkort | 604/256 |
| 5,601,207 | A | * | 2/1997 | Paczonay | 220/703 |
| 5,727,714 | A | * | 3/1998 | Fawcett | 222/175 |
| 5,755,368 | A | * | 5/1998 | Bekkedahl | 224/414 |

* cited by examiner

*Primary Examiner*—Boyer Ashley
(74) *Attorney, Agent, or Firm*—Thomas R. Lampe

(57) ABSTRACT

A method of cutting a resilient workpiece having sides in opposition to one another to form at least one cut in the workpiece includes the steps of stretching the workpiece, maintaining the workpiece in stretched condition by applying clamping forces to the sides of the workpiece after the workpiece has been stretched, cutting the workpiece while it is clamped and stretched to form a cut in and extending through the workpiece, and unclamping the workpiece after the cut has been formed to allow the workpiece to return to unstretched condition and the cut to close.

19 Claims, 7 Drawing Sheets

26A
24
56
60
20A 26A
24
60
20A 26A
24
56
60
20A

METHOD FOR CUTTING A RESILIENT WORKPIECE

This invention is a continuation-in-part of U.S. application Ser. No. 08/615,611, filed Mar. 13, 1996 U.S. Pat. No. 5,601,207 and a continuation-in-part of U.S. application Ser. No. 08/678,585, filed Jul. 11, 1996, U.S. Pat. No. 5,791,510.

TECHNICAL FIELD

This invention relates to the manufacture of resilient workpieces. The invention is particularly applicable to the manufacture of liquid flow control valves, such as bite valves employed in liquid delivery devices for delivering water or other liquids to the mouth of an individuals, for example, cyclists.

The above-identified co-pending applications of which this application is a continuation-in-part disclose apparatus for positioning in the mouth of an individual, such as a cyclist, for selectively delivering liquid from a liquid source for consumption by the individual. These devices are in the nature of bite valves incorporating a deformable closure having one or more slits formed therein which are opened upon application of opposed external forces on the apparatus. The slit or slits will automatically close after termination of application of external forces.

DISCLOSURE OF INVENTION

The present invention encompasses both an apparatus and a method for cutting a workpiece having opposed first and second sides and formed from resilient material to create at least one cut in the workpiece extending between the first and second sides. The apparatus and method of the invention, as disclosed herein, have particular application to the manufacture of bite valves of the type referenced above. Utilizing the teachings of the present invention, one or more openings in the form of slits are formed in the resilient diaphragm of the bite valve while the diaphragm is in stretched condition. When practicing the teachings of the present invention a bite valve is manufactured which operates reliably to effectively seal off fluid flow through the bite valve when opposed bite forces are not applied thereto. The principles of the present invention are applicable to workpieces other than bite valves, for example other types of fluid flow control valves.

A workpiece constructed with the method and apparatus of this invention need not have any specific configuration to work properly. Thus, the workpiece need not be aligned in any particular manner with the cutter blade employed in the method. With this method, the section of the workpiece that is cut will be predisposed to seal. If, however, the current method is employed to cut a workpiece with a special sealing structure, the resilient slit will have enhanced sealing ability over a workpiece that is cut in a non-stretched manner.

The apparatus of the present invention includes first workpiece engagement means for engaging the first side of a workpiece. A second workpiece engagement means is provided for engaging the second side of the workpiece while the first side is engaged by the first workpiece engagement means. The second workpiece engagement means is cooperable with the first workpiece engagement means during relative movement between the first workpiece engagement means and the second workpiece engagement means to stretch the workpiece.

The apparatus also incorporates cutting means movable relative to the workpiece to cut the workpiece and form at least one cut in the workpiece extending between the first and second sides of the workpiece after the workpiece has been stretched by the first workpiece engagement means and the second workpiece engagement means and while the workpiece is in stretched condition.

The first workpiece engagement means and the second workpiece engagement means have opposed clamping surfaces for clampingly engaging the workpiece to maintain the workpiece in stretched condition while the cut is formed in the workpiece by the cutting means.

The invention also encompasses a method of cutting a workpiece having opposed first and second sides and formed from resilient material to create at least one cut in the workpiece extending between the first and second sides.

The method comprises the steps of stretching the workpiece and maintaining the workpiece in stretched condition.

While maintaining the workpiece in stretched condition, the stretched workpiece is cut to form at least one cut in the stretched workpiece extending between the first and second sides of the workpiece.

After the cutting step, the workpiece is allowed to return to an essentially unstretched condition.

The step of maintaining the workpiece in stretched condition comprises applying opposed clamping forces to the workpiece, one of the clamping forces being applied to the first side of the workpiece and the other of the clamping forces being applied to the second side of the workpiece.

Other features, advantages, and objects of the present invention will become apparent with reference to the following description and accompanying drawings.

MODES FOR CARRYING OUT THE INVENTION

Figure 1:
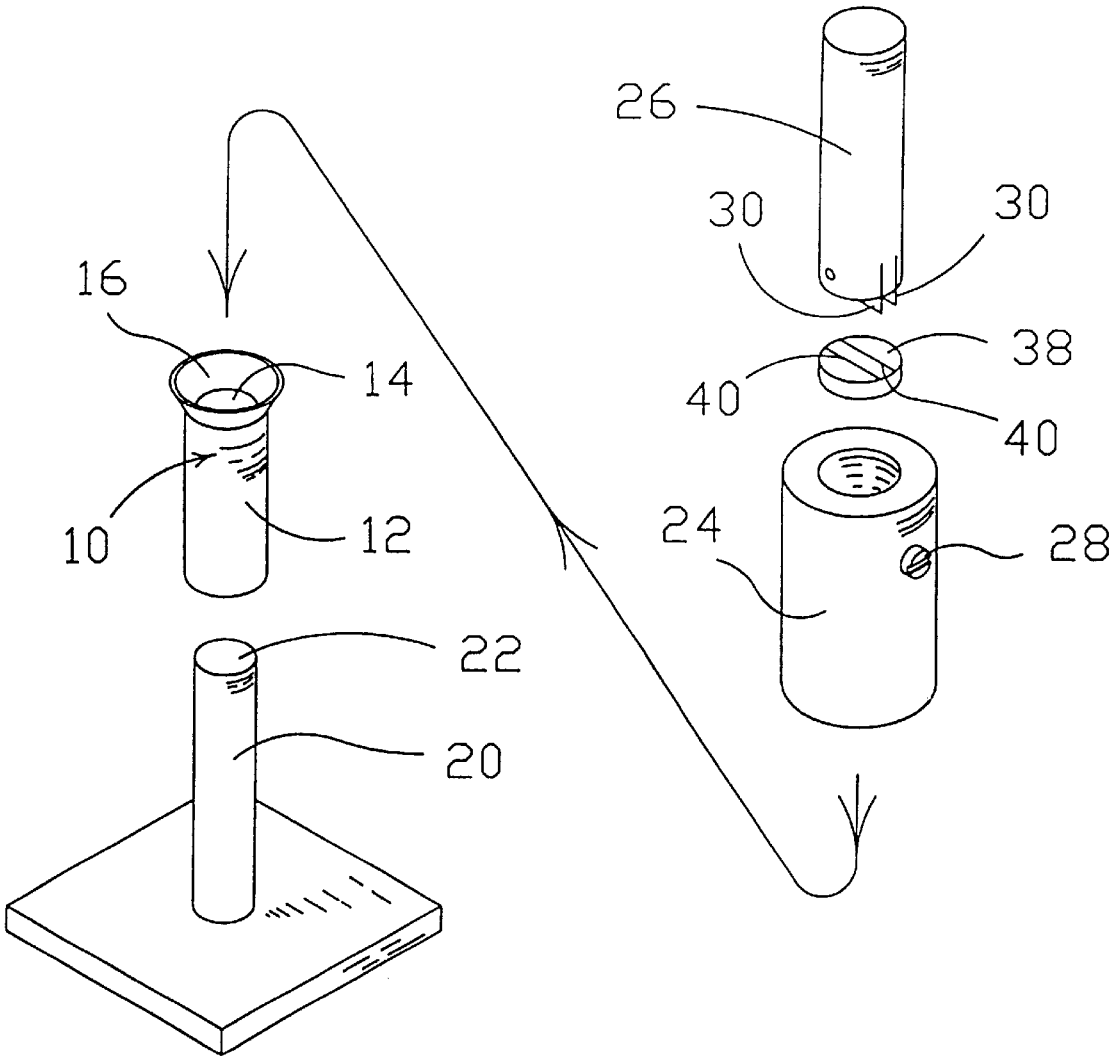
FIG. 1 is an exploded, perspective view illustrating structural components of a first embodiment of apparatus constructed in accordance with the teachings of the present invention prior to assembly and in conjunction with a bite valve that will have slits formed in the diaphragm thereof by the apparatus.

Referring now to FIGS. 1, 2A–2C and 4, apparatus constructed in accordance with the teachings of the present invention is disclosed which is for the purpose of cutting two parallel slits in a workpiece 10.

Workpiece 10 is in the nature of a bite valve, including a tubular-shaped element 12 having an interior closed by a resilient diaphragm 14. A flange 16 projects outwardly from the tubular-shaped element from a location adjacent to the resilient diaphragm. As illustrated, the flange has an inner surface in the form of a truncated cone converging in the direction of the diaphragm. The bite valve 10 is of integral construction, being formed of rubber or other suitable resilient material.

The apparatus includes a mandrel 20 having a flat distal end 22. The mandrel is inserted into the interior of tubular-shaped element 12 with the distal end 22 engaging the bottom side of diaphragm 14.

The apparatus additionally includes another component which is for the purpose of engaging the top side of the diaphragm 14. More particularly, such component includes a tubular housing 24. Positioned in the interior of the housing 24 is a blade mount 26, the blade mount 26 being selectively releasably attached to the housing within the housing interior by a set screw 28.

Two cutting blades 30 are connected to blade mount 26 and project from the blade mount within the housing interior. The cutting blades are spaced and parallel to one another. Preferably, the cutting blades 30 are releasably attached to the blade mount 26. In the arrangement illustrated, the cutting blades 30 are located in parallel slots defined by the blade mount. A set screw 34 is employed to lock the blades in place, the set screw passing through aligned apertures formed in the blades.

The housing 24 and the blade mount 26 cooperate to define a recess 36 accommodating a resilient pad 38 formed of spongy rubber or the like. Two slits 40 are formed in resilient pad 38 which accommodate and are in alignment with cutting blades 30.

Figures 2A, 2B, 2C:
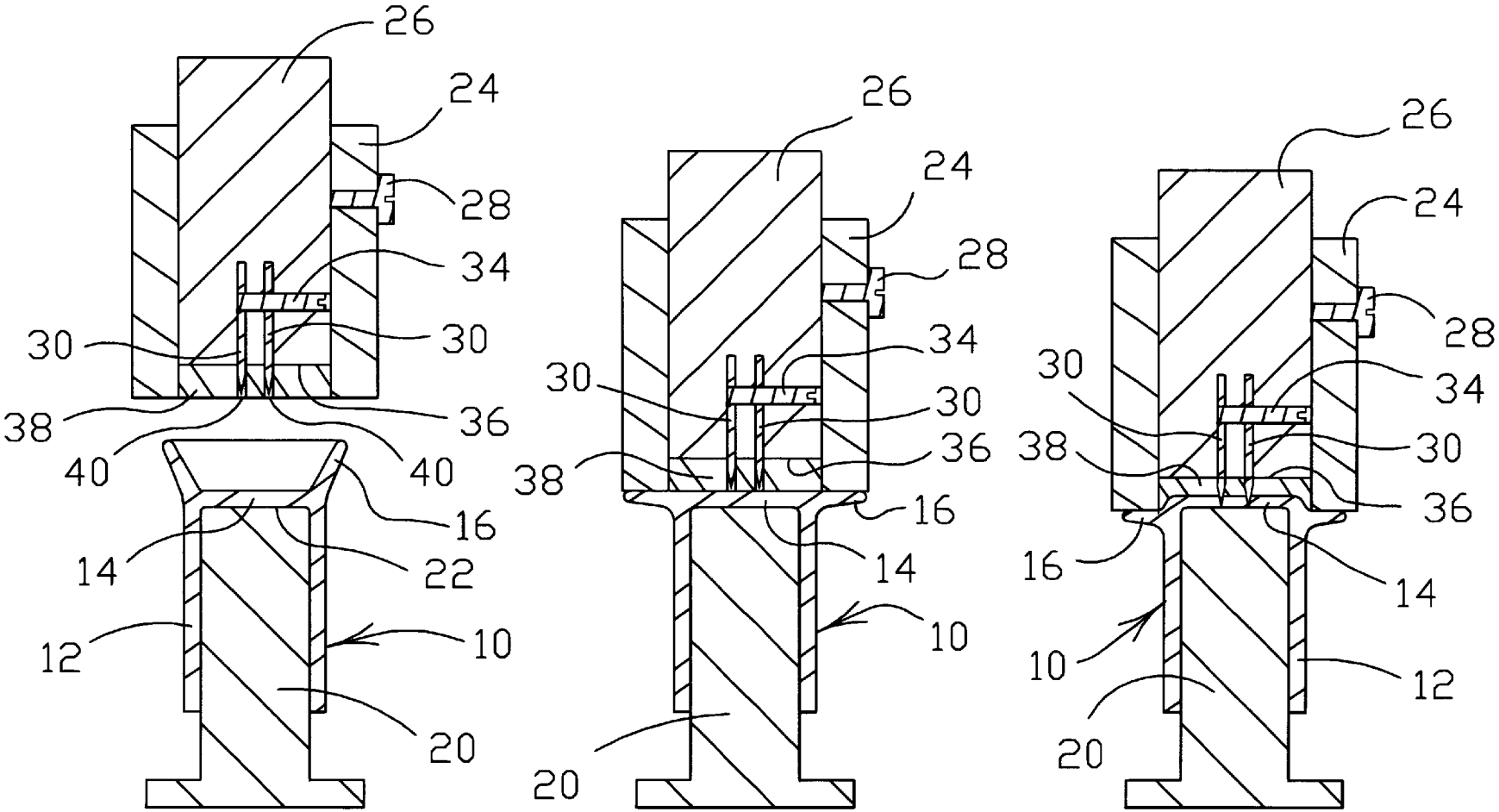
FIGS. 2A–2C are cross-sectional views of the apparatus and bite valve illustrating the sequential steps being carried out when forming slits in the bite valve utilizing the apparatus and in accordance with the method of the present invention.

FIG. 2A shows the assembly just described in position over bite valve 10 supported by mandrel 20.

In FIG. 2B the assembly including the housing 24, the blade mount 26, the cutting blades 30, and the resilient pad 38 has been moved downwardly relative to the mandrel and bite valve and is in engagement with the bite valve. When the assembly is in the illustrated position shown in FIG. 2B the rigid end of housing 24 has engaged flange 16 and has deflected the flange downwardly as shown so that the resilient pad 38 is in engagement with the top side or surface of the diaphragm 14.

Continued downward movement of the assembly will cause the diaphragm 14 to enter recess 36 as shown in FIG. 2C.

Engagement of the flange 16 by the housing 24 and downward deflection thereof as shown in FIGS. 2B and 2C will cause the diaphragm to be stretched in radial fashion. The mandrel 20 and relatively movable housing trap the bite valve therebetween and cause radial outwardly directed forces to be exerted on the diaphragm as illustrated diagrammatically in FIG. 4.

The resilient pad 38 and mandrel distal end 22 apply opposed clamping surfaces to the stretched diaphragm so that the diaphragm is in stretched condition when continued downward movement of blades 30 forms slits in the diaphragm.

Figure 4:
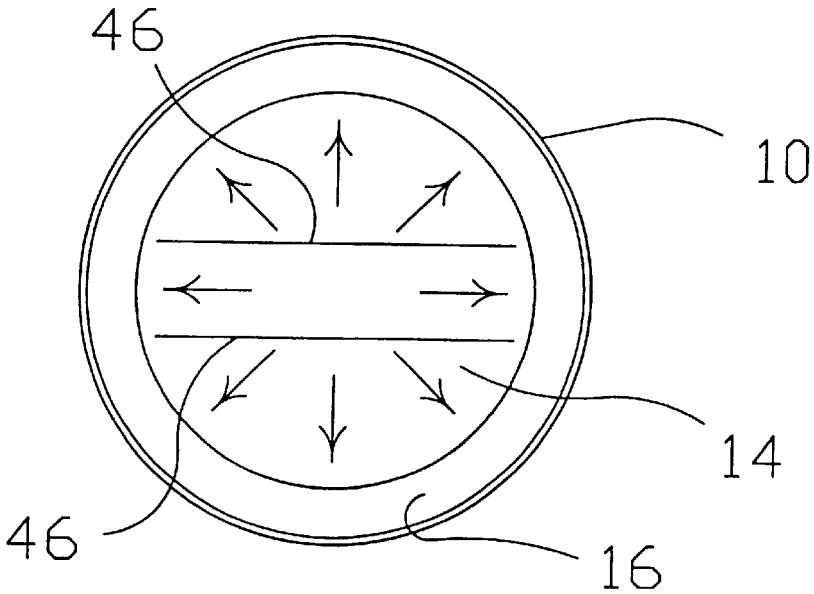
FIG. 4 is a plan view diagrammatically illustrating the pattern of forces applied to the diaphragm of the bite valve when employing the apparatus of FIG. 1.

These slits, which are designated by reference numeral 46 in FIG. 4, extend completely through the diaphragm from the top side to the bottom side thereof. After the slits are cut, the upper assembly of the apparatus (as viewed in FIGS. 2A–2C) is moved out of engagement with the bite valve. The bite valve is then removed from the mandrel. It has been found that cutting of the slits 46 in this manner provides a secure liquid-type seal at the locations of the slits until the bite valve is bit during use to open the slits.

Figure 3:
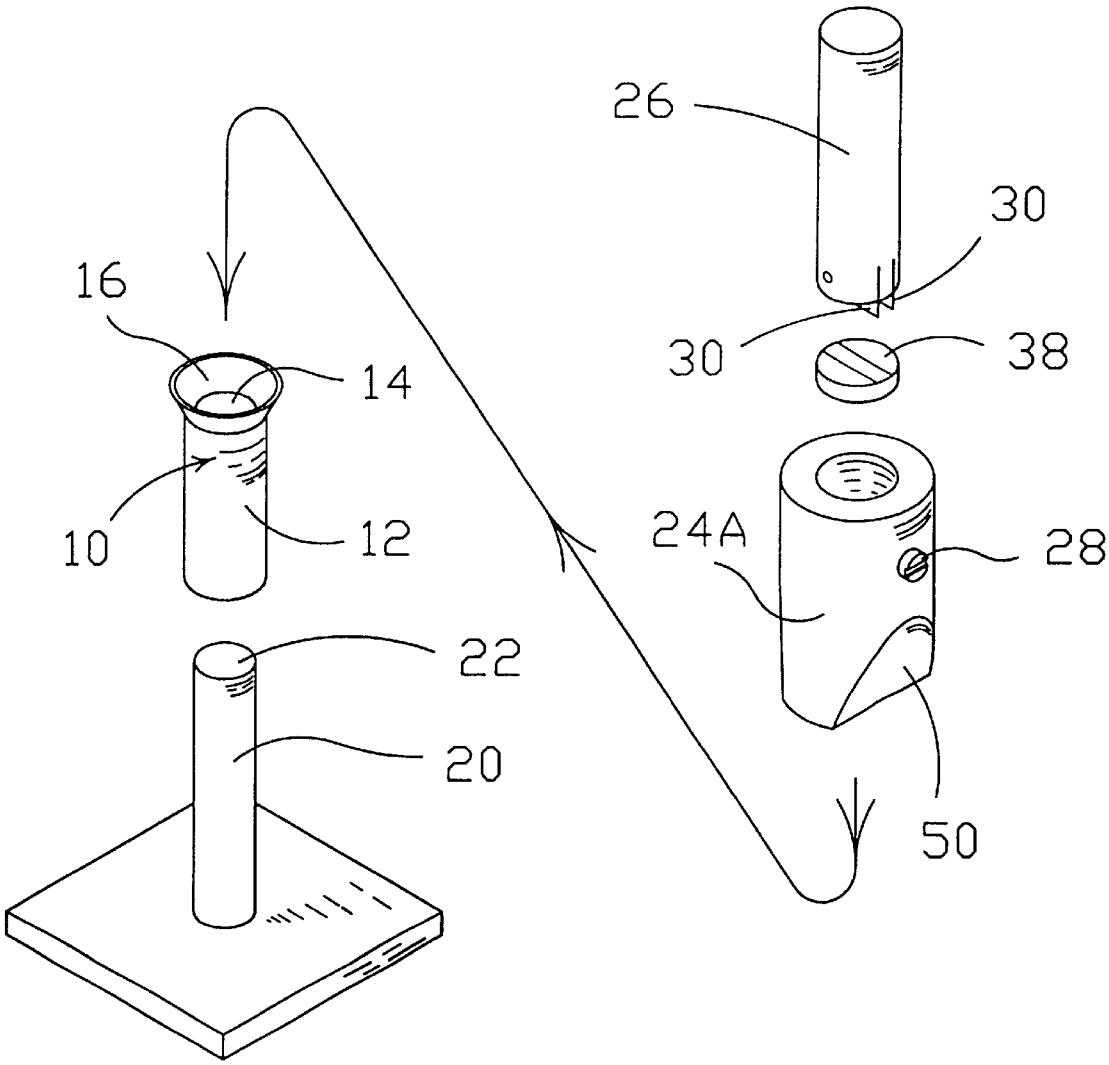
FIG. 3 is a view similar to that of FIG. 1 but illustrating an alternate embodiment of the invention apparatus.

FIG. 3 illustrates an alternative embodiment of the invention which is identical in all respects to the first embodiment discussed above except for the fact that housing 24A has two indents formed at the bottom thereof and in opposition to one another. Only one of the indents 50 is observable in FIG. 3, it being understood that an indent of like configuration is located in opposition thereto. The disclosed indents are beveled surfaces slanting inwardly toward the bottom end of the housing 24A.

Figure 5:
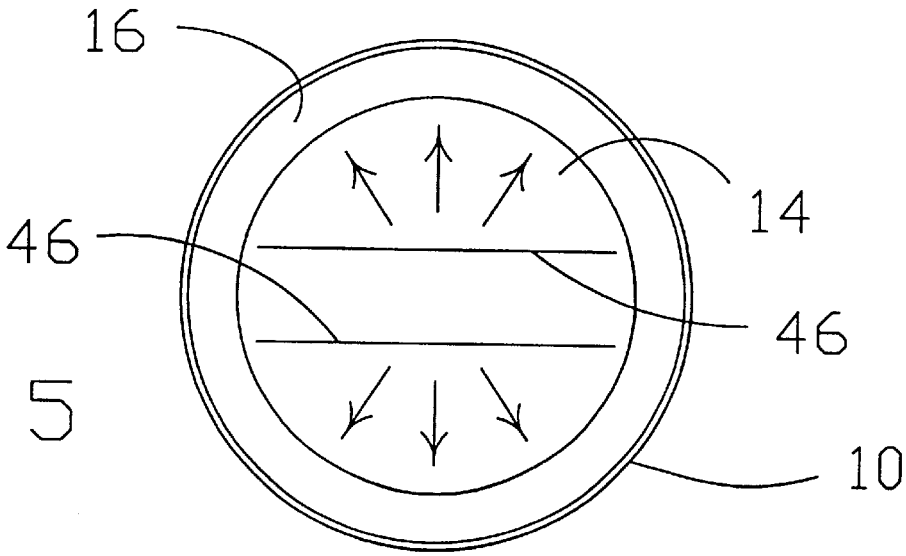
FIG. 5 is a view similar to FIG. 4, but illustrating diagrammatically the forces applied to the diaphragm of the bite valve when utilizing the embodiment of the apparatus shown in FIG. 3.

If a housing of the nature of 24A is utilized as previously described with respect to housing 24 to engage bite valve 10, the stretching of the resilient diaphragm 14 will not be uniformly radial as was the case when housing 24, which is round at the workpiece engaging end thereof, is utilized, but rather the resilient diaphragm 14 will be stretched nonuniformly and primarily along a linear stretch axis. That is, the diaphragm will be stretched more at the locations where the housing 24A is rounded than where it is beveled. FIG. 5 depicts diagrammatically with arrows the stretch characteristics resulting from the use of a housing such as housing 24A. In this instance, the linear stretch axis is essentially orthogonal to the direction of slits 46. This would be accomplished by centering the blades 30 with the indents or bevels 50.

Figure 6C:
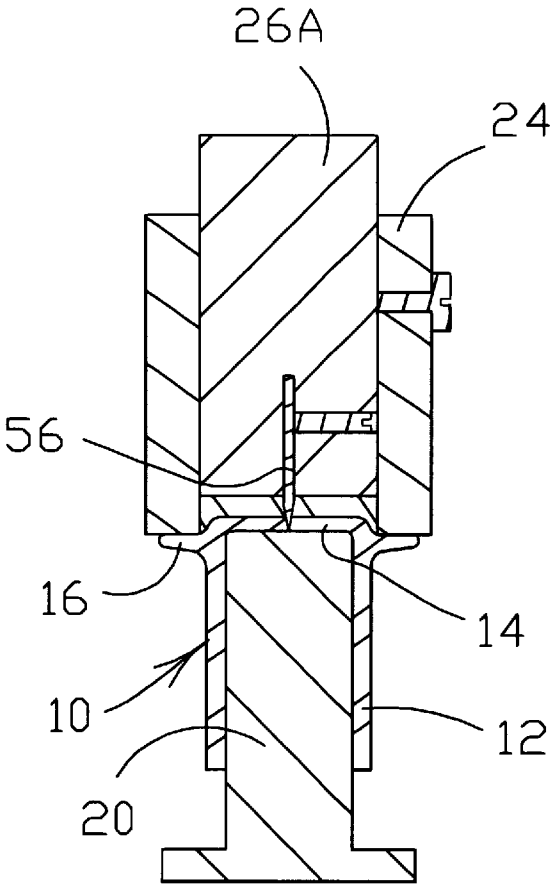
FIGS. 6A–6C are cross-sectional side views of a third embodiment of the apparatus illustrating the sequential stages of operation when cutting a bite valve.
Figure 6B:
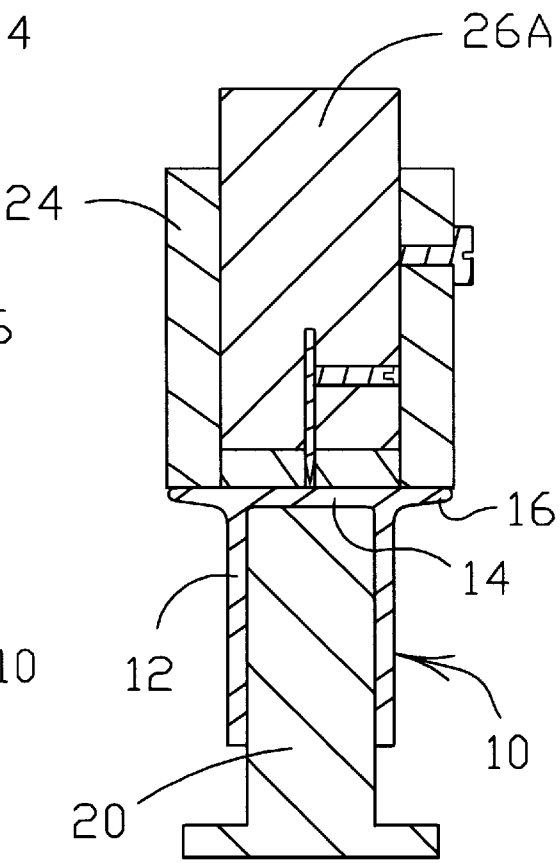
Figure 6A:
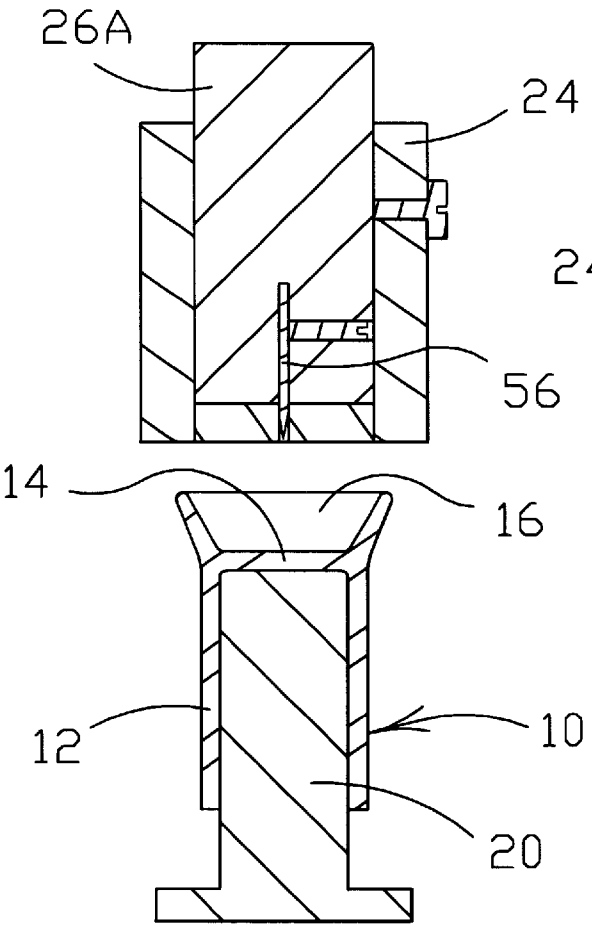

FIGS. 6A–6C illustrate apparatus which is identical in all respects to the apparatus of the first embodiment described above except that only a single cutting blade 56 is connected to blade mount 26A. This will result in formation of only a single slit in diaphragm 14 after the diaphragm has been stretched and clamped as previously described.

Figure 7A:
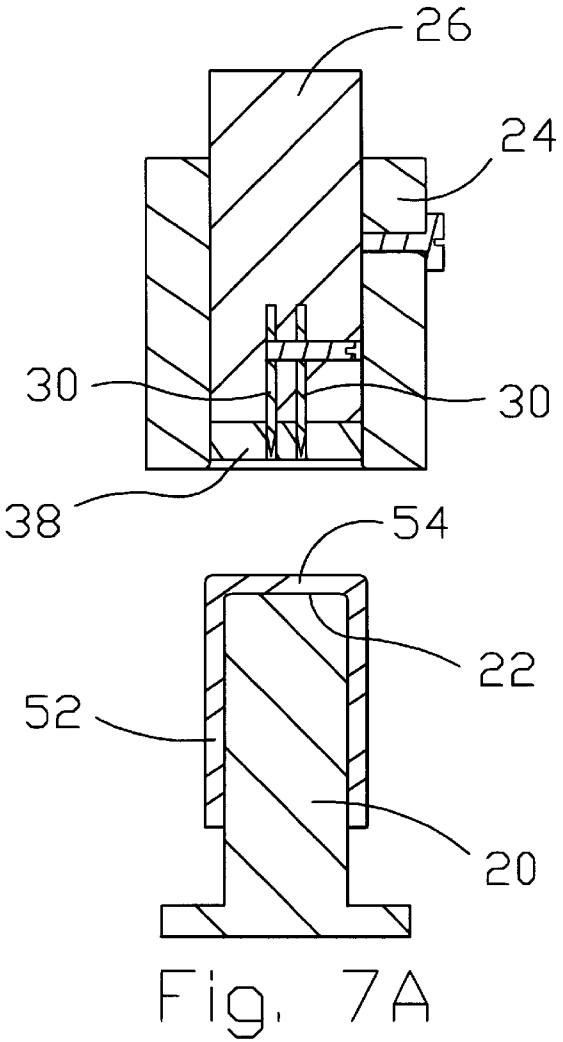
FIGS. 7A–7C are cross-sectional side views illustrating the embodiment of the apparatus shown in FIG. 1 to cut a different shaped workpiece.
Figure 7B:
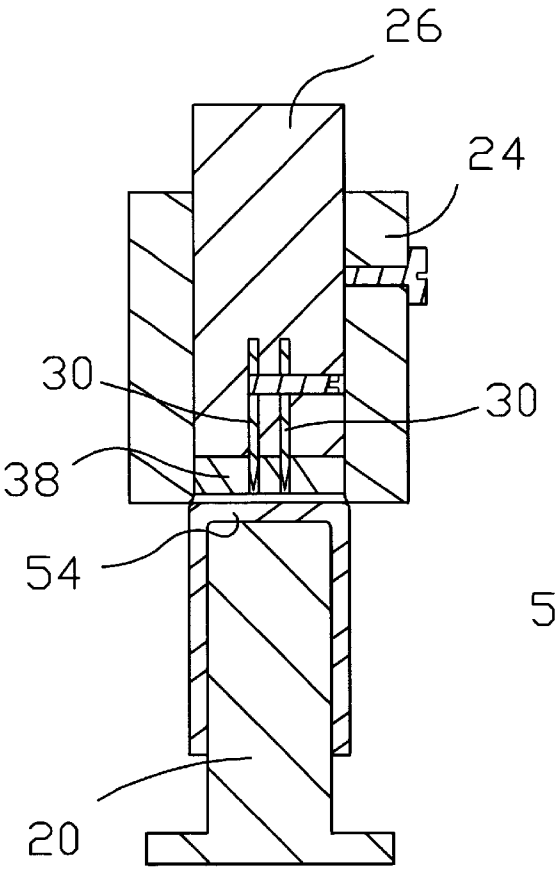
Figure 7C:
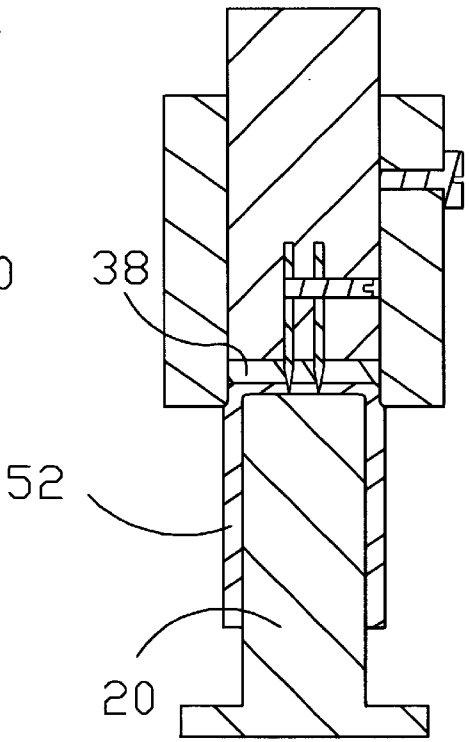

FIGS. 7A–7C show the apparatus of the first embodiment, i.e. the embodiment shown in FIG. 1, used to form two slits in a workpiece consisting of a tubular-shaped element 52 and a resilient diaphragm 54. This workpiece too, for example, may be a bite valve; however, it does not employ a flange.

FIGS. 7A–7C show the sequential steps being carried out when forming two slits in resilient diaphragm 54. The housing and related structure are positioned over the mandrel 20 and the workpiece as shown in FIG. 7A and then the housing lower end is brought into engagement with the bite valve at the outer circular edge of the bite valve. Continued lowering of the housing and associated structure will stretch the diaphragm as previously described, the diaphragm then being clamped between resilient pad 38 and the mandrel distal end 22. While the diaphragm is in stretched condition, continued movement of the housing relative to the mandrel will cause the blades 30 to form two slits in the resilient diaphragm 54. The housing and structure connected thereto is then raised out of engagement with the bite valve and the diaphragm will return to its unstressed condition.

Figures 8A, 8B, 8C:
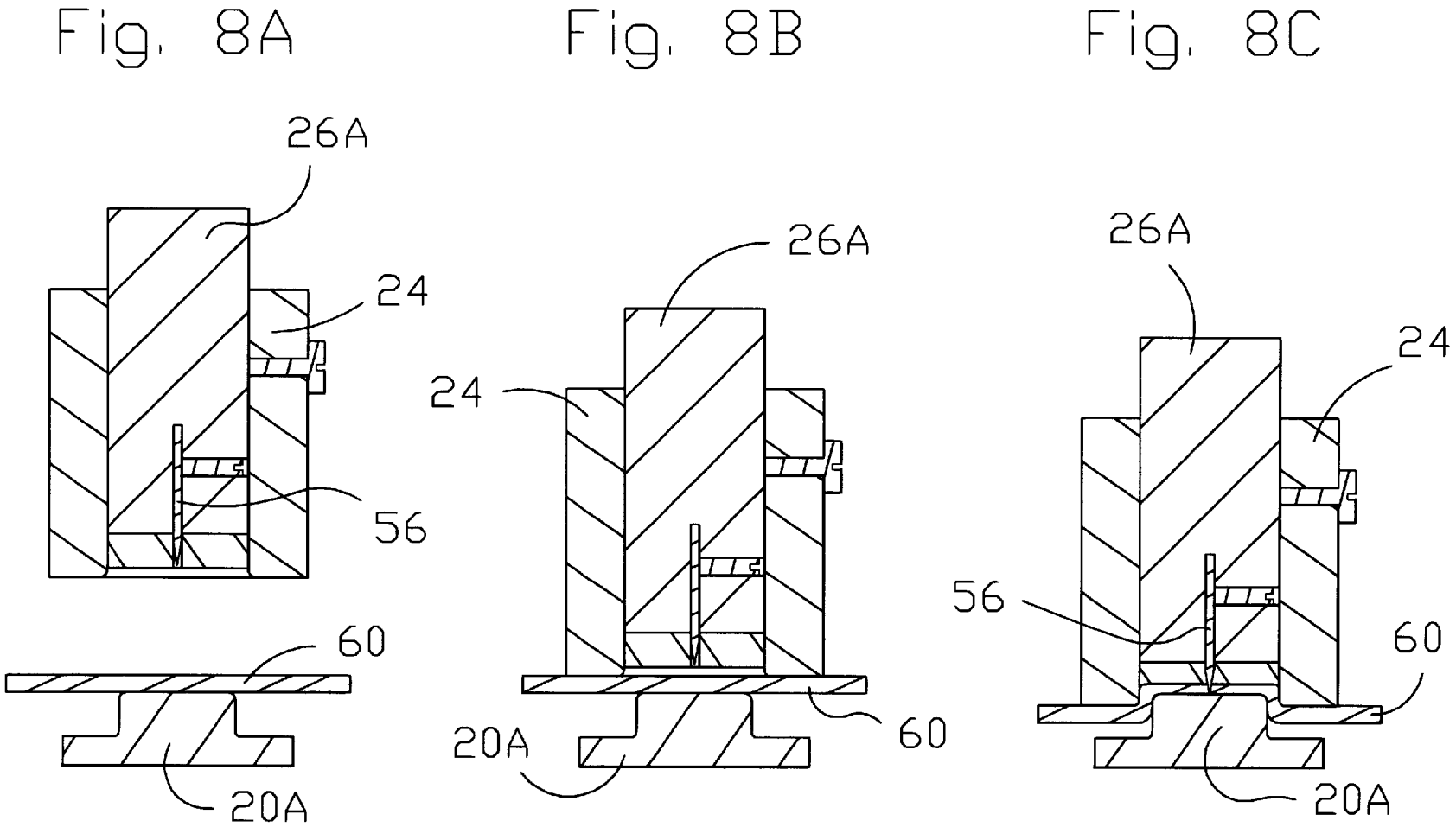
FIGS. 8A–8C illustrate sequential steps carried out when utilizing the embodiment of the invention shown in FIGS. 6A–6C to cut yet another form of workpiece.

FIGS. 8A–8C illustrate apparatus constructed in accordance with the teachings of the present invention being used to pierce a workpiece 60 which is constructed of rubber or other resilient material and normally has a planar configuration. For example, workpiece 60 may be a flat disc which may be subsequently used as a fluid control valve. The only difference between the illustrated apparatus shown in FIGS. 8A–8C and that shown in FIGS. 6A–6C is that the mandrel 20A of the embodiment under discussion is shorter.

FIG. 8B illustrates the lower end of rigid housing 24 in engagement with the workpiece 60. Then as shown in FIG. 8C continued downward movement of the housing and associated structure relative to the workpiece and mandrel 20A will serve to stretch the workpiece at the central diaphragm portion thereof positioned on mandrel 20A since the workpiece about the periphery of the central portion is pinched between the housing and mandrel and forced downwardly to some extent. The stretched central diaphragm portion of the workpiece is clamped between the resilient pad and mandrel and the blade 56 forms a slit passing through the central diaphragm portion of the workpiece before the housing and associated structure are withdrawn from the workpiece.

I claim:

1. A method of cutting a stretchable resilient fluid flow control valve member having first and second fluid flow control valve member sides in opposition to one another to create at least one cut in said fluid flow control valve member extending through said fluid flow control valve member between said first and second fluid flow control valve member sides, said method comprising the steps of:

stretching said fluid flow control valve member from an unstretched condition to a stretched condition by applying opposed stretching forces thereto at predetermined locations on said fluid flow control valve member, said first and second fluid flow control valve member sides being stretched when said fluid flow control valve member is in said stretched condition;

maintaining said fluid flow control valve member in said stretched condition;

while maintaining said fluid flow control valve member in said stretched condition, cutting said fluid flow control valve member within an interior area of said fluid flow control valve member spaced from and positioned between said predetermined locations to form at least one cut in said fluid flow control valve member extending through said fluid flow control valve member between said first and second fluid flow control valve member sides by causing relative movement between a cutter and the fluid flow control valve member along a predetermined path of relative movement, said predetermined path of relative movement being disposed at an angle relative to said stretched first and second fluid flow control valve member sides; and after said cutting step, removing said stretching forces and allowing said fluid flow control valve member to return to an unstretched condition to close the at least one cut so that said fluid flow control valve member forms a substantially liquid-tight seal at said at least one cut, said step of maintaining said fluid flow control valve member in said stretched condition including applying opposed clamping forces to said fluid flow control valve member in said interior area of said fluid flow control valve member, one of said clamping forces being applied to the first fluid flow control valve member side while said first fluid flow control valve member side is stretched and another of said clamping forces being applied to the second fluid flow control member side while said second fluid flow control member side is stretched, and said clamping forces being applied substantially in the direction of said predetermined path of relative movement to the first and second fluid flow control member sides in said interior area of said fluid flow control valve member immediately surrounding where said at least one cut is made in said interior area during said cutting step.

2. The method according to claim 1 wherein the step of applying clamping forces to said fluid flow control valve member includes pressing a resilient clamp member against a side of said fluid flow control valve member during said cutting step.

3. The method according to claim 1 wherein said cutting step comprises forming at least one slit in said stretched fluid flow control valve member.

4. The method according to claim 1 wherein said cutting step comprises forming a plurality of slits in said stretched fluid flow control valve member.

5. The method according to claim 1 wherein the step of stretching said fluid flow control valve member comprises simultaneously applying radial pulling forces to said fluid flow control valve member.

6. The method according to claim 1 wherein the cutting step comprises forming at least one slit having a primary slit axis in said stretched fluid flow control valve member and wherein the step of stretching said fluid flow control valve member comprises applying opposed pulling force primarily in predetermined directions.

7. The method according to claim 1 wherein said predetermined path of relative movement is disposed substantially at right angles to said stretched first and second fluid flow control valve member sides.

8. The method according to claim 1 wherein said fluid flow control valve member comprises a diaphragm attached to a tubular element having an interior and closing an end of said interior, said cutting step comprising forming at least one slit in said diaphragm.

9. The method according to claim 8 including the steps of inserting a mandrel having a distal end within said tubular element and supporting said diaphragm with the distal end of the mandrel during said cutting step.

10. The method according to claim 1 wherein said cutting step comprises substantially simultaneously forming a plurality of slits in said fluid flow control valve member when said fluid flow control valve member is in the stretched condition.

11. The method according to claim 10 wherein said plurality of slits are parallel.

12. A method of cutting a stretchable resilient fluid flow control valve member having first and second sides in opposition to one another to create at least one cut in said fluid flow control valve member extending through said fluid flow control valve member between said first and second sides, said method comprising the steps of:

stretching said fluid flow control valve member in a direction extending along said first and second sides to a stretched condition by applying stretching forces thereto at predetermined locations on said fluid flow control valve member;

maintaining said fluid flow control valve member in a stretched condition with said fluid flow control valve member stretched in a direction of stretch extending along said first and second sides;

while maintaining said fluid flow control valve member in the stretched condition, cutting said fluid flow control valve member within an interior area of said fluid flow control valve member spaced from and positioned between said predetermined locations to form at least one cut in said fluid flow control valve member extending through said fluid flow control valve member between said first and second sides and within the confines of said fluid flow control valve member by causing relative movement between a cutter and the fluid flow control valve member along a predetermined path of relative movement differing in direction from said direction of stretch; and after said cutting step, allowing said fluid flow control valve member to return to an unstretched condition to close the at least one cut to form a seal at said at least one cut, said step of maintaining said fluid flow control valve member in said stretched condition including applying opposed clamping forces to said fluid flow control valve member in said interior area of said fluid flow control valve member, one of said clamping forces being applied to the first side of said fluid flow control valve member while the fluid flow control valve member is stretched and another of said clamping forces being applied to the second side of said fluid flow control valve member while the fluid flow control valve member is stretched, and said clamping forces being applied substantially in the direction of said predetermined path of relative movement to the first and second sides of said fluid flow control valve member and substantially surrounding the position in said interior area where said at least one cut is formed.

13. A method of cutting a stretchable resilient wall of a valve element, said wall having first and second sides in opposition to one another, to create at least one cut in said wall extending through said wall between said first and second sides, said method comprising the steps of:

stretching said wall in a stretch direction extending along said first and second sides from an unstretched condition by applying stretching forces thereto at predetermined locations on said valve element;

maintaining said wall in a stretched condition with said wall stretched in the stretch direction extending along said first and second sides;

while maintaining said wall in the stretched condition, cutting said wall within an inner area of said wall spaced from said predetermined locations to form at least one cut in said wall extending through said wall between said first and second sides of said wall by causing relative movement between a cutter and the wall along a predetermined path of relative movement differing in direction from the stretch direction; and after said cutting step, allowing said wall to return to an unstretched condition to close the at least one cut and form a seal at said at least one cut, said step of maintaining said wall in the stretched condition including applying opposed clamping forces to said wall in said inner area of said wall while said wall is stretched, one of said clamping forces being applied to the first side of said wall and another of said clamping forces being applied to the second side of said wall, and said clamping forces being applied substantially in the direction of said predetermined path of relative movement to the first and second sides of said wall and substantially surrounding the position in said inner area where said at least one cut is formed.

14. The method according to claim 13 wherein said clamping forces are applied to said wall in said inner area immediately surrounding where said at least one cut is formed during said cutting step.

15. A method of cutting a stretchable resilient wall to form an orally activated valve including said wall, said wall having first and second sides in opposition to one another, by creating at least one cut in said wall extending through said wall between said first and second sides, said method comprising the steps of:

stretching said wall from an unstretched condition by applying stretching forces thereto at predetermined locations on said wall;

maintaining said wall in a stretched condition with said wall stretched in a stretch direction extending along said first and second sides;

while maintaining said wall in the stretched condition, cutting said wall within an inner area of said wall spaced from said predetermined locations to form at least one cut in said wall extending through said wall between said first and second sides of said wall by causing relative movement between a cutter and the wall along a predetermined path of relative movement having a direction differing from the stretch direction of said stretched wall; and after said cutting step, allowing said wall to return to an unstretched condition to close the at least one cut and form a seal at said at least one cut, said step of maintaining said wall in the stretched condition including applying opposed clamping forces to said wall in said inner area of said wall while said wall is stretched, one of said clamping forces being applied to the first side of said wall and another of said clamping forces being applied to the second side of said wall, and said clamping forces being applied substantially in the direction of said predetermined path of relative movement to the first and second sides of said wall and substantially surrounding the position in said inner area where said at least one cut is formed.

16. The method according to claim 15 wherein said clamping forces are applied in said inner area immediately surrounding where said at least one cut is formed during said cutting step.

17. A method of cutting a stretchable resilient wall of a valve element, said resilient wall having first and second sides in opposition to one another, to create at least one cut in said resilient wall extending through said resilient wall between said first and second sides, said method comprising the steps of:

deforming and stretching said resilient wall by applying deforming and stretching forces thereto at spaced predetermined locations on said valve element, said deforming and stretching forces stretching said resilient wall in a stretch direction extending along said first and second sides;

maintaining said resilient wall in a deformed and stretched condition with said wall stretched in said stretch direction extending along said first and second sides;

while maintaining said resilient wall in the deformed and stretched condition, cutting said wall within an inner area of said wall between and spaced from said predetermined locations to form at least one cut in said wall extending through said wall between said first and second sides of said wall by causing relative movement between a cutter and the wall along a predetermined path of relative movement differing in direction from said stretch direction; and after said cutting step, allowing said stretchable, resilient wall to return to an undeformed and unstretched condition to close the at least one cut and form a seal at said at least one cut, said step of maintaining said resilient wall in the deformed and stretched condition including applying a first clamping force to the first side of said wall and applying a second clamping force to the second side of said wall, said clamping forces being applied substantially in the direction of said predetermined path of relative movement to the first and second sides of said wall and substantially surrounding the position in said inner area where said at least one cut is formed.

18. The method according to claim 17 wherein said clamping forces are applied in said inner area immediately surrounding where said at least one cut is formed during said cutting step.

19. A method of cutting a stretchable resilient fluid flow control valve member having first and second sides in opposition to one another to create at least one cut in said fluid flow control valve member extending through said fluid flow control valve member between said first and second sides, said method comprising the steps of:

stretching said fluid flow control valve member from an unstretched condition by applying stretching forces thereto at predetermined locations on said fluid flow control valve member;

maintaining said fluid flow control valve member in a stretched condition;

while maintaining said fluid flow control valve member in the stretched condition, cutting said fluid flow control valve member within an interior area of said fluid flow control valve member spaced from said predetermined locations to form at least one cut in said fluid flow control valve member extending through said fluid flow control valve member between said first and second sides of said fluid flow control valve member by causing relative movement between a cutter and the fluid flow control valve member along a predetermined path of relative movement; and after said cutting step, removing said stretching forces and allowing said fluid flow control valve member to return to an unstretched condition to close the at least one cut so that said fluid flow control valve member forms a substantially liquid-tight seal at said at least one cut, said step of maintaining said fluid flow control valve member in the stretched condition including applying clamping forces to said fluid flow control valve member in said interior area of said fluid flow control valve member, one of said clamping forces being applied to the first side of said fluid flow control valve member and another of said clamping forces being applied to the second side of said fluid flow control valve member, and said clamping forces being applied substantially in the direction of said predetermined path of relative movement to the first and second sides of said fluid flow control valve member in said interior area of said fluid flow control valve member immediately surrounding where said at least one cut is made during said cutting step, said fluid flow control valve member comprising a diaphragm attached to a tubular element having an interior and closing an end of said interior, said cutting step comprising forming at least one slit in said diaphragm, said tubular element having a flange projecting outwardly therefrom at a location adjacent to said diaphragm, said step of stretching said fluid flow control valve member including exerting external forces on said flange to pull and stretch said diaphragm.

* * * * *